US007262355B2

(12) United States Patent
Hagiwara et al.

(10) Patent No.: US 7,262,355 B2
(45) Date of Patent: Aug. 28, 2007

(54) SNARE STRAINER

(75) Inventors: Takashi Hagiwara, Yokohama (JP); Norihiko Ishimatsu, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 215 days.

(21) Appl. No.: 11/033,203

(22) Filed: Jan. 11, 2005

(65) Prior Publication Data

US 2005/0223875 A1 Oct. 13, 2005

(30) Foreign Application Priority Data

Jan. 14, 2004 (JP) ..... 2004-007151

(51) Int. Cl.
*G10D 13/02* (2006.01)

(52) U.S. Cl. ..... 84/415; 84/415; 84/416; 84/417

(58) Field of Classification Search ..... 84/415–417
See application file for complete search history.

(56) References Cited

U.S. PATENT DOCUMENTS

| | | | | | |
|---|---|---|---|---|---|
| 1,724,888 | A * | 8/1929 | Strupe | 84/415 |
| 3,113,481 | A * | 12/1963 | Thompson | 84/415 |
| 3,210,994 | A * | 10/1965 | Saxl | 73/862.471 |
| 3,525,313 | A * | 8/1970 | Jordan | 116/314 |
| 3,833,216 | A * | 9/1974 | Philbin | 482/64 |
| 4,201,148 | A * | 5/1980 | Bizzak | 116/241 |
| 4,203,343 | A * | 5/1980 | Bargeman | 84/415 |
| 4,967,634 | A | 11/1990 | Whynott | |
| 5,275,081 | A * | 1/1994 | Freer | 84/415 |
| 5,557,053 | A * | 9/1996 | Nickel | 84/415 |
| 5,684,257 | A * | 11/1997 | Yanagisawa | 84/415 |
| 5,844,157 | A | 12/1998 | Kasha | |
| 5,895,873 | A * | 4/1999 | Yanagisawa | 84/415 |
| 6,008,445 | A | 12/1999 | Chen | |
| 6,093,877 | A * | 7/2000 | Nickel | 84/415 |
| 6,172,288 | B1 * | 1/2001 | Freer | 84/411 R |
| 6,534,698 | B2 * | 3/2003 | Hoshino | 84/415 |
| 6,846,978 | B2 * | 1/2005 | Dorfman et al. | 84/415 |
| 6,958,440 | B2 * | 10/2005 | Yu-Hwa | 84/415 |
| 2005/0223875 | A1 * | 10/2005 | Hagiwara et al. | 84/415 |
| 2005/0241457 | A1 * | 11/2005 | Shimada | 84/415 |

(Continued)

FOREIGN PATENT DOCUMENTS

| | | |
|---|---|---|
| DE | 35 04 024 | 1/1990 |

(Continued)

*Primary Examiner*—Lincoln Donovan
*Assistant Examiner*—Robert W. Horn
(74) *Attorney, Agent, or Firm*—Koda & Androlia

(57) ABSTRACT

A snare strainer adapted to a snare drum comprises first and second strainers, which are attached to opposite positions on the exterior circumferential surface of a drum cylinder and by which a snappy member including snares is controlled to move in close contact with or separate from the backside drumhead upon operation of a switch mechanism. One end of an interconnection member included in the snappy member is held between first and second holding members of the first strainer, and the other end is held between third and fourth holding members of the second strainer. A tension adjustment screw is operated to adjust tension applied to the snappy member, which can be visually observed using the scale. Hence, it is easy for the human operator to attach and replace the snappy member and to replace the backside drumhead with another drumhead in a short period of time.

7 Claims, 8 Drawing Sheets

U.S. PATENT DOCUMENTS

2006/0219084 A1* 10/2006 Dunnett ..... 84/415
2006/0266198 A1* 11/2006 Jeffries et al. ..... 84/417

FOREIGN PATENT DOCUMENTS

GB 2 259 395 3/1993
GB 2259395 A * 3/1993
JP 56-77892 (U) 6/1981
JP 58-50372 (U) 11/1983
JP 60-163500 (U) 10/1985

* cited by examiner

SNARE STRAINER

BACKGROUND OF THE INVENTION

1. Field of the Invention

This invention relates to snare strainers that control snappy members including snares to move in close contact with or separate from drumheads of snare drums.

This application claims priority on Japanese Patent Application No. 2004-7151, the content of which is incorporated herein by reference.

2. Description of the Related Art

Snare drums produce special sound effects called tumbling effects, wherein snappy members including a plurality of thin snares are controlled to move in close contact with or separate from backside drumheads (corresponding to non-striking sides of snare drums), or they are controlled to move in close contact with or separate from both of backside drumheads and front-side drumheads (corresponding to striking sides of snare drums), so that vibrations of drumheads are transmitted to snares to produce pattering or rattling sounds having light tone colors. The following documents teach adjustments of snares adapted to snare drums.

(a) Japanese Examined Utility Model Publication No. S58-50372.

(b) U.S. Pat. No. 6,008,445.

(c) U.S. Pat. No. 5,844,157.

FIG. 8 is a perspective view showing the exterior appearance of a conventionally know snare drum having a snappy member, which is attached in relation to a backside drumhead; and FIG. 9 is an exploded perspective view showing essential parts of the structure for assembling a snappy member with a snare strainer. Herein, reference numeral 1 designates a snare drum; reference numeral 2 designates a drum body, i.e., a drum cylinder having openings at both ends thereof; reference numeral 3 designates a backside drumhead covering the backside opening of the drum cylinder 2; reference numeral 4 designates a hoop (or a clamp frame) engaged with each of the openings of the drum cylinder; reference numeral 5 designates lugs; reference numeral 6 designates clamp bolts for interconnecting the hoops 4 and the lugs 5 together; reference numeral 7 designates a snappy member that is attached in relation to the backside drumhead 3; reference numeral 8 designates a first strainer for holding a moving end 7A of the snappy member 7; and reference numeral 9 designates a second strainer for holding a fixed end 7B of the snappy member 7. The snare strainer is constituted by the strainers 8 and 9.

The snappy member 7 comprises a plurality of thin snares 11, which are arranged in parallel with each other with prescribed distances therebetween in a direction perpendicular to the longitudinal direction, a pair of snappy plates 12, which are arranged apart from and opposite to each other and to which opposite ends of the snares 11 are fixedly soldered, and interconnection members 13 having flexibility, which are attached to the snappy plates 12 respectively. The interconnection members 13 are each made by strings or wires, wherein they are each detachably held between a pair of holding plates 14A and 14B with respect to the first strainer 8 and the second strainer 9 respectively.

The first strainer 8 controls the moving end 7A of the snappy member 8 to move in close contact with or separate from the backside drumhead 3, wherein it is constituted by a fixed base 15, which is fixed to the exterior circumference of the drum cylinder 2, a moving base 16, which is attached to the fixed base 15 and is subjected to bidirectional movement relative to the fixed base 15 (see directions designated by arrows A and B in FIG. 9), a switch mechanism 17, which allows the bidirectional movement of the moving base 16 relative to the fixed base 15 so that the moving end 7A of the snappy member 7 correspondingly moves in close contact with or separates from the backside drumhead 3, and a tension adjustment screw 18, which allows the bidirectional movement of the moving member 16 relative to the fixed member 15 so as to adjust the tension applied to the snappy member 7. The holding plates 14A and 14B are clamped and fixed together at the tip end portion of the moving base 16 by two square-headed bolts 19 such that the interconnection member 13 is held therebetween.

The fixed end 7B of the snappy member 7 is interconnected with the second strainer 9, which is not designed to move the fixed end 7B in close contact with or separate from the backside drumhead 3 and is thus not designed to adjust the tension applied to the snappy member 7. For this reason, compared with the first strainer 8, the second strainer 9 is designed with a simple structure. Specifically, the second strainer 9 has a fixed base, by which it is fixed to the drum cylinder 2, and it does not include other members corresponding to the moving base 16, switch mechanism 17, and tension adjustment screw 18 of the first strainer 8 described above. Similar to the first strainer 8, the second strainer 9 has a pair of holding plates (14A and 14B) for holding the 'string-like' interconnection member 13 attached to the fixed end 7B of the snappy member 7.

The aforementioned structure allows the snappy member 7 to be attached to the snare strainer comprising the first strainer 8 and the second strainer 9. Herein, when the snare drum 1 is played without using the snappy member 7, the switch mechanism 17 of the first strainer 8 is operated to move the moving base 16 in a forward direction towards the backside drumhead 3 so that the snares 11 of the snappy member 7 are separated from the backside drumhead 3. When the snare drum 1 is played by use of the snappy member 7, the switch mechanism 17 is operated to move the moving base 16 in a backward direction so that the snares 11 move in close contact with the surface of the backside drumhead 3. In such a close contact state, when the front-side drumhead is struck with a stick and the like, the vibration is transmitted to the snares 11 via the backside drumhead 3, so that the snares 11 correspondingly vibrate; thus, it is possible for the snare drum 1 to realize the special sound effect to produce the pattering or rattling sounds having the light tone color.

In the conventional structure for attaching the snappy member 7 in association with the first strainer 8 and the second strainer 9, the interconnection members 13 respectively attached to both ends of the snappy member 7 are each held between the 'paired' holding plates 14A and 14B, which are fixed to the tip end portion of the moving base 16 (or fixed base) by use of the two square-headed bolts 19. Therefore, it is impossible to replace the backside drumhead 3 with another drumhead unless the two bolts 19 are released so as to remove the interconnection member 13 from the space between the paired holding plates 14A and 14B. After replacement, it is necessary for the human operator to hold the interconnection member 13 between the paired holding members 14A and 14B, which are then fixed to the moving base 16 (or fixed base) by use of the two square-headed bolts 19. This requires troublesome work for the human operator.

In a drumhead replacement mode, the held condition of the interconnection member 13 held between the paired holding members 14A and 14B should be temporarily released. After the replacement of the backside drumhead 3, it is necessary for the human operator to attach the snappy member 7 to the snare drum 1 again, wherein it is necessary to greatly readjust the tensions of the snares 11 by adjusting the positional relationship between the interconnection member 13 and the paired holding plates 14A and 14B. This requires a relatively long time for the replacement of the backside drumhead 3. Of course, similar troublesome work should be required to replace the existing snares (or the existing snappy member) with other types of snares (or another snappy member).

SUMMARY OF THE INVENTION

It is an object of the invention to provide a snare strainer adapted to a snare drum, wherein a snappy member can be easily attached to and detached therefrom, and wherein in the replacement of a drumhead, it is unnecessary to greatly readjust the tensions of snares, so that the drumhead can be replaced with another one with ease and within a short period of time.

A snare strainer of this invention includes a first strainer and a second strainer, which are attached to opposite positions on the exterior circumferential surface of a drum cylinder and by which a snappy member including snares is controlled to move in close contact with or separate from a backside drumhead of a snare drum. Herein, the first strainer comprises a first fixing base that is fixed to the exterior circumferential surface of the drum cylinder, a moving base that is attached to the first fixing base in a free movement manner, a switch mechanism that moves the moving base relative to the first fixing base so as to move the snappy member in close contact with or separate from the drumhead, and a pair of first and second holding members that hold an interconnection member having flexibility at one end of the snappy member, wherein the first holding member has a fastening portion and a base fixing portion, which is detachably attached to the moving base.

In the above, the second strainer comprises a second fixing base that is fixed to the exterior circumferential surface of the drum cylinder, and a pair of third and fourth holding members that hold the interconnection member at the other end of the snappy member, wherein the third holding member has a fastening portion and a base fixing portion, which is detachably attached to the second fixing base.

In addition, through holes allowing insertion of the interconnection member therein and engagement grooves are formed in the fastening portion of the first holding member (and third holding member), and a pressing member for pressing the interconnection member into the engagement grooves is integrally formed with the second holding member (and fourth holding member).

The first strainer is equipped with a tension adjustment means (i.e., a tension adjustment screw) for adjusting tension applied to the snappy member, wherein the moving base has a scale for visually showing the movement of the moving base moved by the tension adjustment means.

Furthermore, a plurality of positioning means (i.e., projections and recesses engaging with each other) are arranged to establish the prescribed positioning between the base fixing portion of the first holding member and the moving base (and the prescribed positioning between the base fixing portion of the third holding member and the second fixing base).

In the aforementioned structure, the backside drumhead can be replaced with another drumhead by removing the base fixing portion of the first holding member from the moving base (and by removing the base fixing portion of the third holding member from the second fixing base), wherein it is unnecessary for the human operator to temporarily release the tightly fastened condition of the interconnection member, which is held between the first and second holding members and is also held between the third and fourth holding member. This makes it easy for the human operator to replace the backside drumhead with another one, and this also makes it unnecessary for the human operator to readjust the tension that is defined by the positional relationships between the snappy member and the holding members. In addition, the snappy member whose interconnection member is held between the holding members can be collectively replaced with a new one. That is, it is very easy for the human operator to replace the snappy member equipped with the interconnection member and holding members with a new one.

Due to the provision of the pressing members, it is possible to reliably prevent the interconnection members from being accidentally removed from the holding members because the interconnection member is firmly fixed and engaged into the engagement grooves.

In addition, the human operator can visually determine the degree of adjustment regarding the tension applied to the snappy member (or snares) by looking at the scale roughly representing the movement of the moving base.

Due to the provision of the positioning means, it is possible to establish the prescribed positioning between the first holding member and the moving base and between the third holding member and the second fixing base; hence, it is possible to prevent parts of the snare strainer from being unexpectedly dropped or removed when the backside drumhead is replaced with another one. In addition, the positioning means reliably prevents the holding means from being rotated; hence, the paired holding members can be easily detachably combined together by use of a single bolt, a single screw, and the like.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
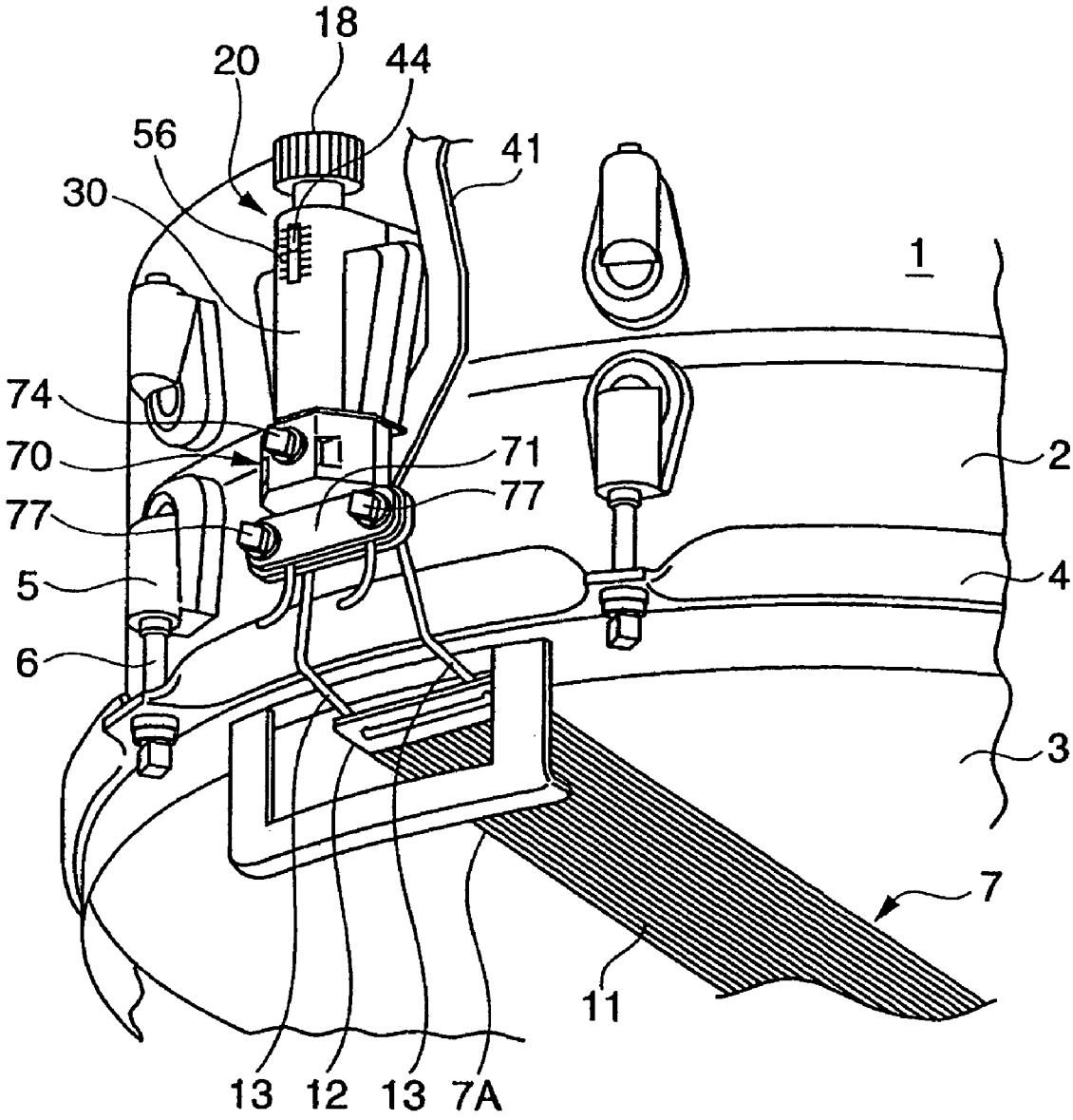
FIG. 1 is a perspective view showing essential parts of a snare drum in which a moving end of a snappy member is interconnected with a first strainer in accordance with a preferred embodiment of the invention.
Figure 2:
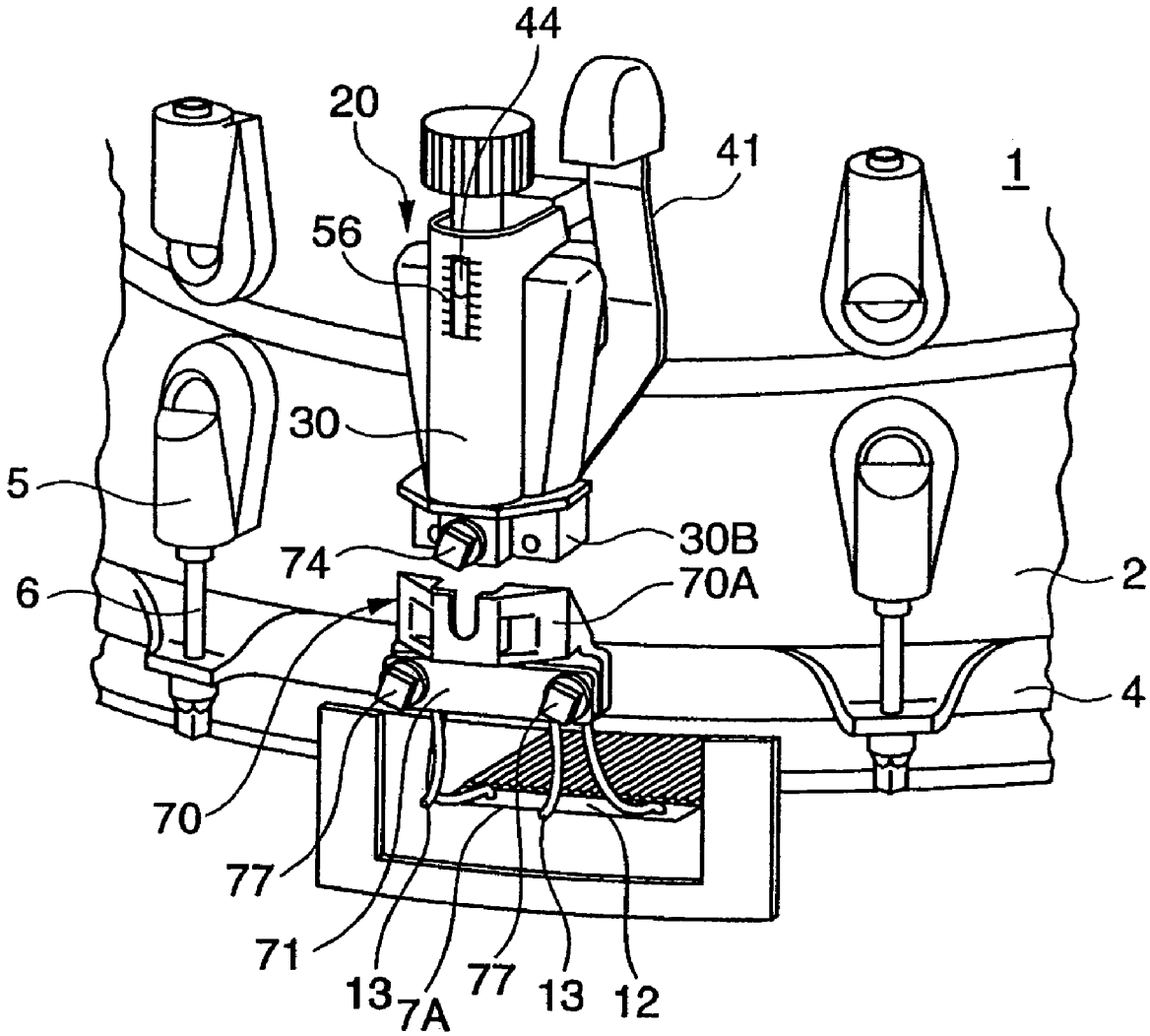
FIG. 2 is a perspective view showing essential parts of the snare drum in which the moving end of the snappy member is released from the interconnected state with the first strainer.
Figure 3:
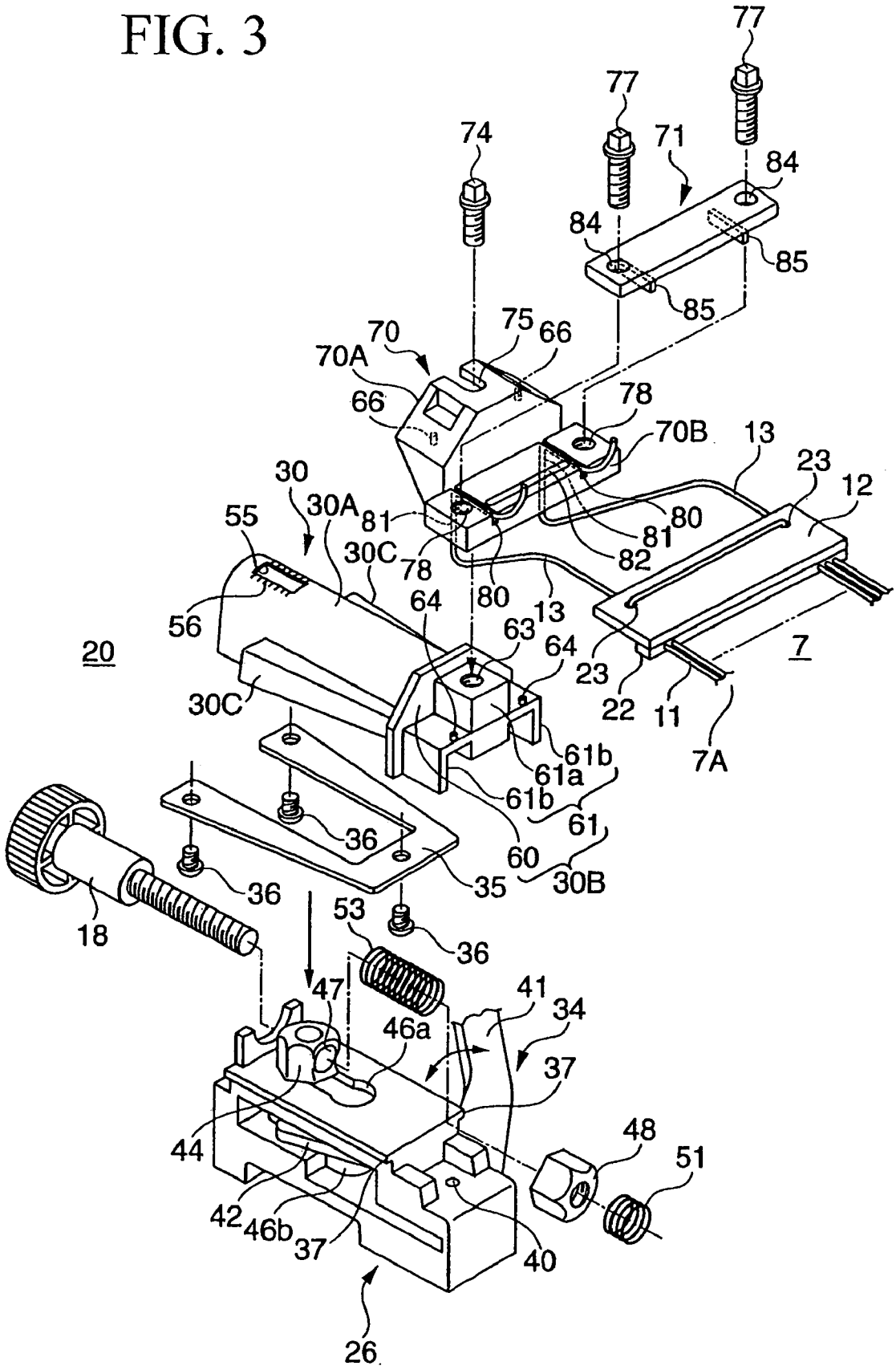
FIG. 3 is an exploded perspective view showing essential parts of the first strainer.
Figure 4A:
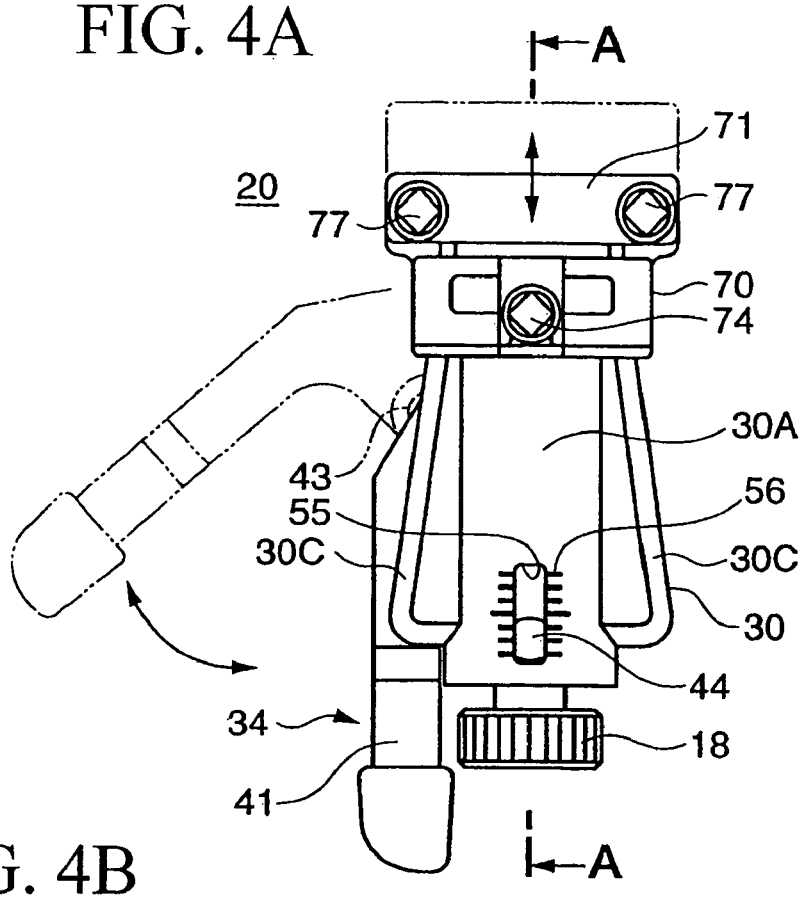
FIG. 4A is a front view of the first strainer.
Figure 4B:
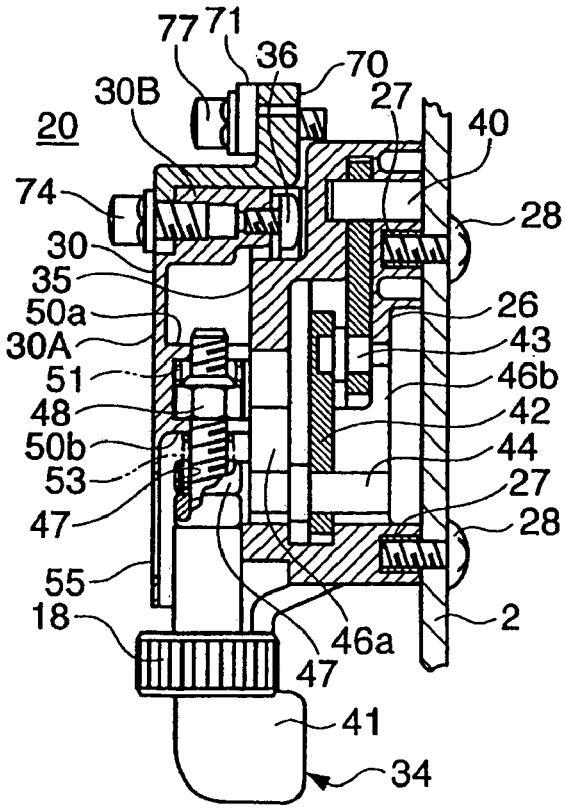
FIG. 4B is a cross-sectional view taken along line A-A in FIG. 4A.
Figure 4C:
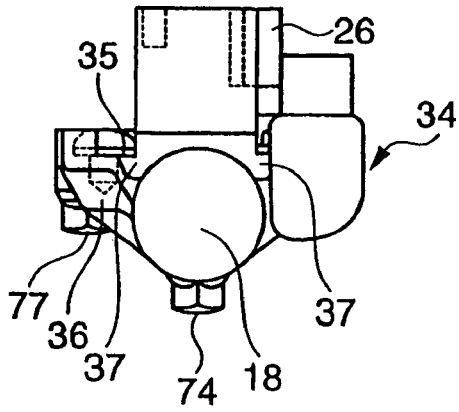
FIG. 4C is a bottom view of the first strainer.
Figure 5A:
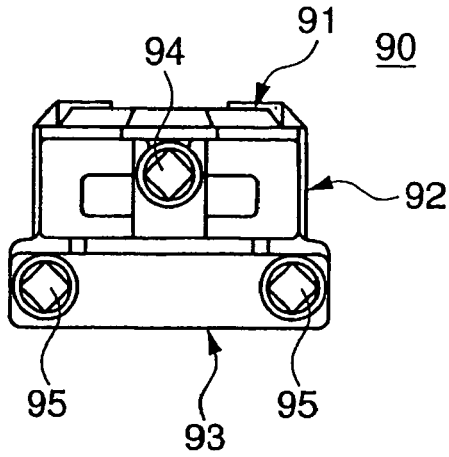
FIG. 5A is a plan view of a second strainer.
Figure 5B:
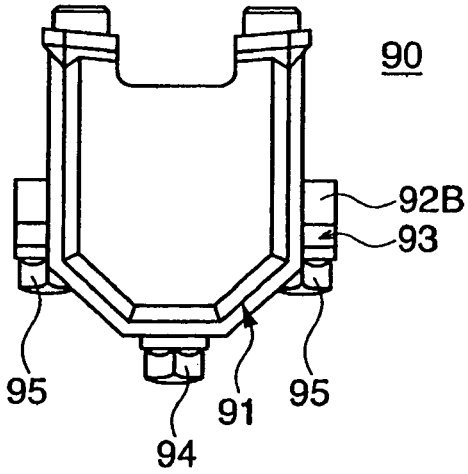
FIG. 5B is a rear view of the second strainer.
Figure 5C:
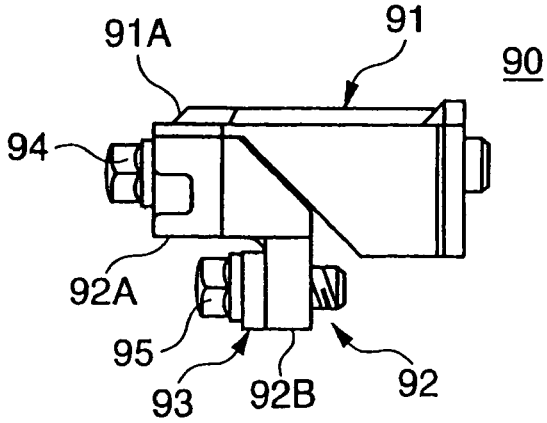
FIG. 5C is a side view of the second strainer.
Figure 6:
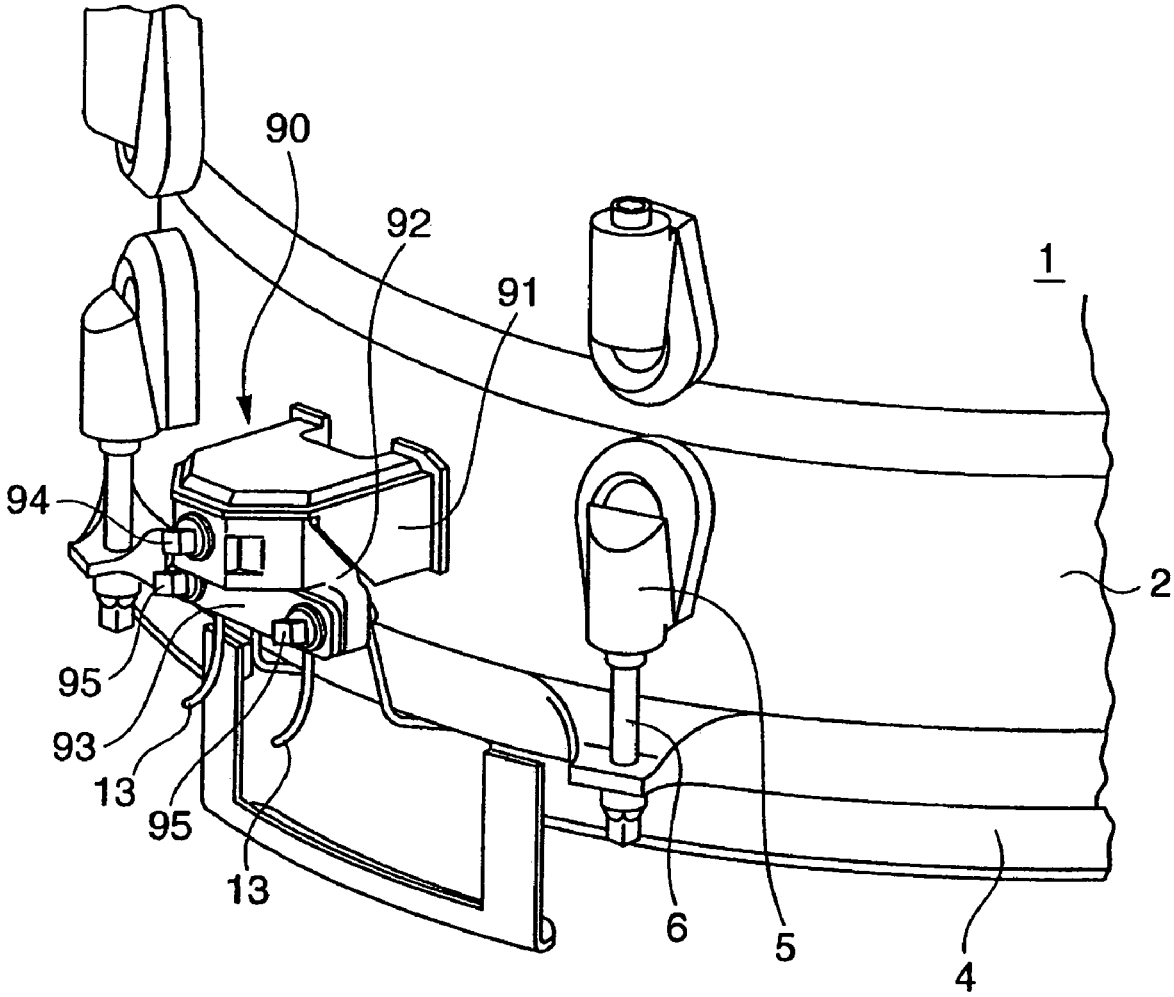
FIG. 6 is a perspective view showing essential parts of the snare drum in which a fixed end of the snappy member is interconnected with the second strainer.
Figure 7:
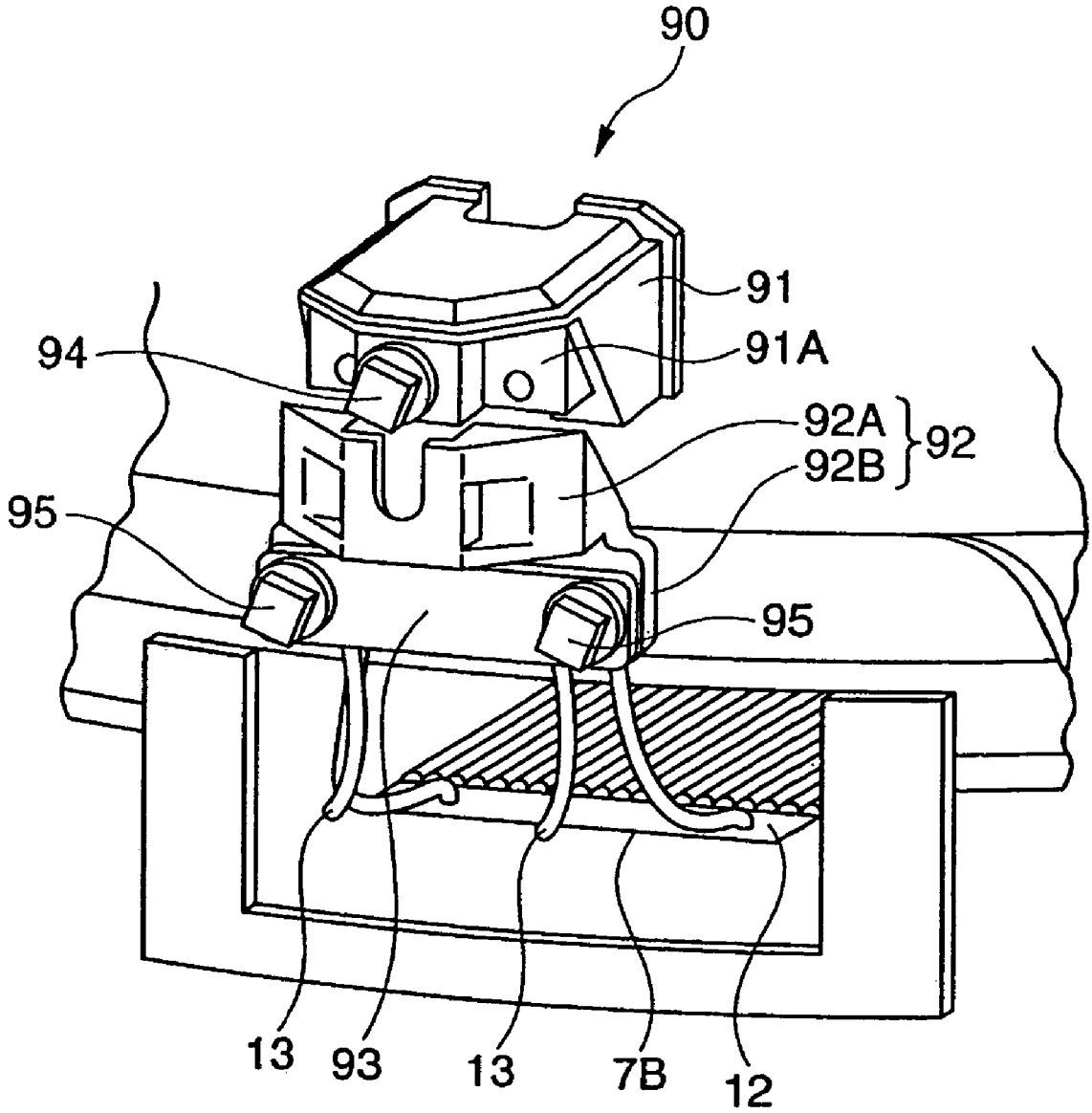
FIG. 7 is a perspective view showing essential parts of the snare drum in which the fixed end of the snappy member is released from the interconnected state with the second strainer.
Figure 8:
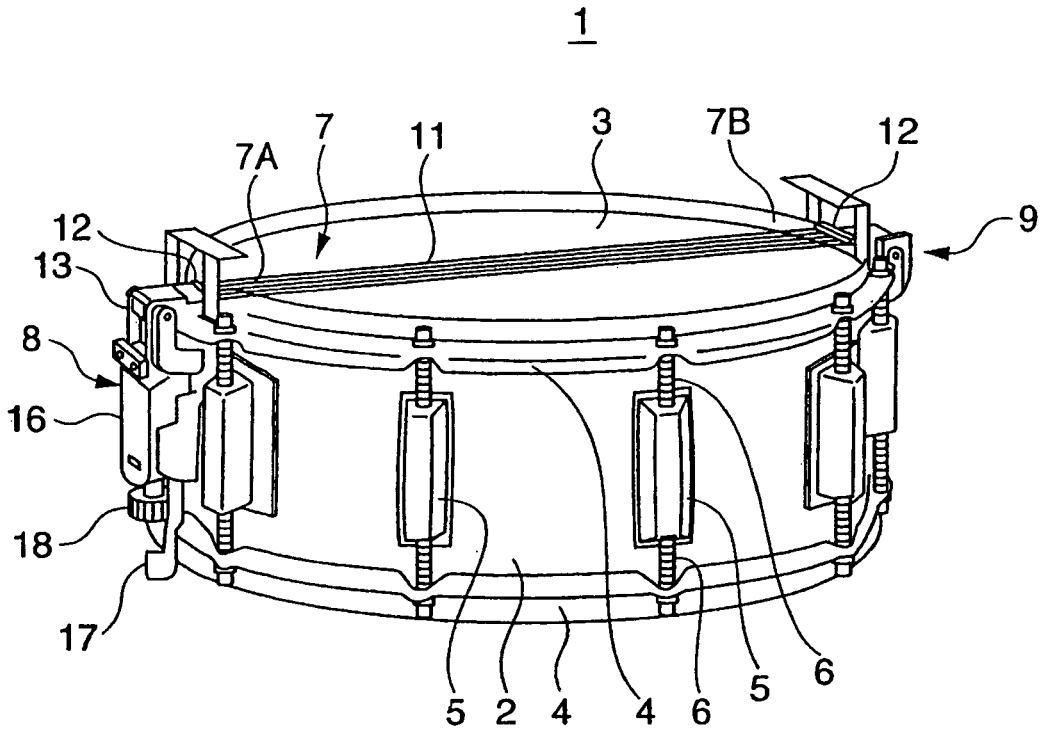
FIG. 8 PRIOR ART
FIG. 8 is a perspective view showing the exterior appearance of a conventionally known snare drum in which a snappy member is attached in relation to a backside drumhead.
Figure 9:
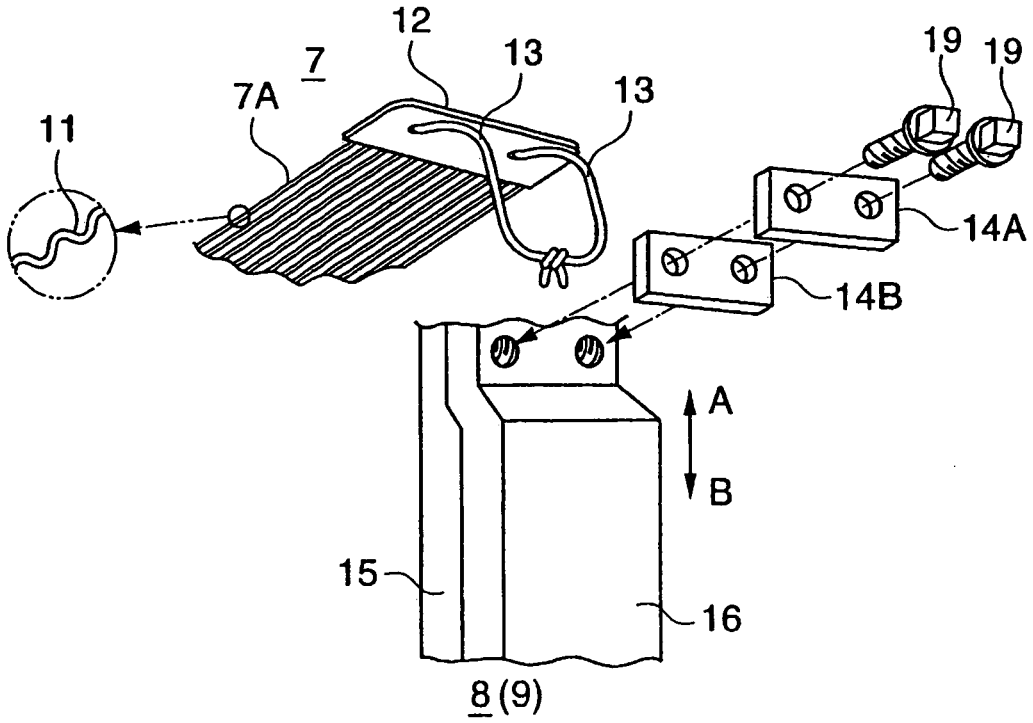
FIG. 9 PRIOR ART
FIG. 9 is an exploded perspective view showing the structure for attaching the snappy member to a strainer in the snare drum shown in FIG. 8.

FIGS. 1, 2, 3, 4A-4C, 5A-5C, 6, and 7 show illustrations regarding a snare strainer adapted to a snare drum in accordance with a preferred embodiment of the invention, wherein parts identical to those shown in FIGS. 8 and 9 are designated by the same reference numerals. Specifically, FIG. 1 is a perspective view showing essential parts of a snare drum in which a moving end of a snappy member is interconnected with a first strainer; FIG. 2 is a perspective view showing essential parts of the snare drum in which the moving end of the snappy member is released from the interconnected state with the first strainer; FIG. 3 is an exploded perspective view showing essential parts of the first strainer; FIG. 4A is a front view of the first strainer; FIG. 4B is a cross-sectional view taken along line A-A in FIG. 4A; FIG. 4C is a bottom view of the first strainer; FIG. 5A is a plan view of a second strainer; FIG. 5B is a rear view of the second strainer; FIG. 5C is a side view of the second strainer; FIG. 6 is a perspective view showing essential parts of the snare drum in which a fixed end of the snappy member is interconnected with the second strainer; and FIG. 7 is a perspective view showing essential parts of the snare drum in which the fixed end of the snappy member is released from the interconnected state with the second strainer.

In the following description, the vertical directions of the strainers are defined regardless of the drum performance in such a way that the front-side drumhead of the snare drum is directed downwards, and the backside drumhead is directed upwards. Due to the restriction of the illustration size in the drawing sheet of FIG. 3, various constituent parts are intentionally drawn in a horizontal manner. The snare strainer of the present embodiment, which is designed to move the snappy member 7 in close contact with or separate from the backside drumhead 3, is constituted by a first strainer 20 (see FIGS. 1, 2, 3, and 4A-4C) and a second strainer 90 (see FIGS. 5A-5C, 6, and 7).

The overall structure of the snappy member 7 of the present embodiment is identical to that of the snappy member 7 shown in FIG. 8, wherein it comprises a plurality of thin snares 11, which are arranged in parallel with each other with prescribed distances therebetween in a direction perpendicular to the longitudinal direction, a pair of snappy plates 12, which are arranged apart from and opposite to each other and to which opposite ends of the snares 11 are fixed by solders 22, and interconnection members 13 having flexibility, which are attached to the snappy plates 12 respectively. The interconnection members 13 are each made by thin strings or wires having appropriate lengths, wherein the center portions thereof are held between through holes 23, which are formed at prescribed end portions of the snappy plates 12 respectively.

In FIGS. 1, 2, 3, and 4A-4C, the first strainer 20 operates the moving end 7A of the snappy member 7 to move in close contact with or separate from the backside drumhead 3, wherein it includes a first fixed base 26 that is fixed to the exterior circumferential surface of the drum cylinder 2. The first fixed base 26 is composed of a synthetic resin and is formed in a slender rectangular parallelopiped, wherein nuts 27 are embedded in both end portions of the rear surface of the first fixed base 26, which is brought in close contact with the exterior circumferential surface of the drum cylinder 2. Stop screws 28 are respectively screwed into the nuts 27 from the interior circumferential surface of the drum cylinder 2, so that the first fixed base 26 is fixed to the exterior circumferential surface of the drum cylinder 2 in such a way that the longitudinal direction thereof matches the axial direction of the drum cylinder 2.

A moving base 30 is attached to the front side of the first fixed member 26 and is equipped at one end thereof with a switch mechanism 34, which allows it to move forward or backward in the longitudinal direction of the first fixed base 26.

As shown in FIG. 3, the moving base 30 is constituted by a main portion 30A having a semi-cylindrical shape, which is made of a metal and which is opened downwards in the rear side thereof (referred to as a rear opening), a fixing portion 30B that is integrally attached to the tip end surface of the main portion 30A, and a pair of extended portions 30C that are integrally attached to both sides of the main portion 30A. A cover plate 35 having a rectangular U-shape in plan view is fixed to the rear opening of the main portion 30A by three screws 36. Both side portions of the cover plate 35 are brought in contact with the backsides of guide portions 37, which integrally project from both sides of the first fixed member 26, in such a way that they can freely slide along the backsides of the guide portions 37 of the first fixed member 26. That is, the cover plate 35 can move while sliding on guiding surfaces corresponding to the backsides of the guide portions 37.

The switch mechanism 34 operates the moving base 30 to move forward or backward relative to the first fixed base 26, thus controlling the moving end 7A of the snappy member 7 to move in close contact with or separate from the backside drumhead 3. It is constituted by an operation lever 41 and a link 42. The upper end of the operation lever 41 is pivotally supported in a free rotation manner by a fixed axis 40 embedded in the upper portion of the first fixed base 26, while the lower end thereof is extended in the lower section of one side of the moving base 30.

As shown in FIG. 4B, the upper end of the link 42 is interconnected to one side of the intermediate portion of the operation lever 41 in its height direction in a free rotation manner via a link axis 43, while the lower end thereof is supported in a free rotation manner by an adjustment axis 44 embedded in the internal lower section of the first fixed base 26. The adjustment axis 44 is located to penetrate through the first fixed base 26 and is supported in a free rotation manner by elongated holes 46*a* and 46*b*, which are formed in the exterior surface and interior surface of the first fixed base 26. The tip end portion of the adjustment axis 44 projects in the front side of the first fixed base 26 and is inserted into the main portion 30A of the moving base 30. A through hole 47, which allows a tension adjuster 18 to adjust tension applied to the snares 11 of the snappy member 7, is formed in the tip end portion of the adjustment axis 44. Incidentally, the tension adjuster 18 is made by a screw (hereinafter, referred to as a tension adjustment screw).

A nut 48, which allows the tip end portion of the tension adjustment screw 18 to engage therewith is embedded inside of the moving base 30 at a prescribed position higher than the adjustment axis 44. The nut 48 is arranged between a pair of partition walls 50*a* ad 50*b*, which project inside of the moving base 30 and which are arranged apart from each other so as to allow the nut 48 to vertically move within a limited distance (see FIG. 4B). Normally, a friction spring 51 presses the nut 48 downward to the 'lower' partition wall 50*b*, thus preventing the nut 48 from floating.

A vertically elongated window 55 is opened in the front lower section of the main portion 30A of the moving base 30 so as to allow a human operator to visually recognize the tip end portion of the adjustment axis 44. A scale 56 (i.e., marks on both lines of the elongated window 55) is printed so as to show an adjustment value of the moving base 30, which is moved by rotation of the tension adjustment screw 18. When the human operator rotates the tension adjustment screw 18 by hand, the nut 48 is moved forward or backward relative to the tension adjustment screw 18. Specifically, when the nut 48 moves forwards, it presses the 'upper' partition wall 50*a* so as to realize the forward movement of the moving base 30; and when the nut 48 moves backwards, it presses the 'lower' partition wall 50*b* so as to realize the backward movement of the moving base 30. At this time, the human operator can easily grasp the adjustment value of the moving base 30 by viewing the tip end portion of the adjustment axis 44, which is vertically moved in connection with the scale 56. That is, the tension applied to the snares 11 is varied in proportion to the adjustment value of the moving base 30. The present embodiment is designed such that the moving base 30 moves by way of a special slide mechanism described above. Of course, it is possible to use conventionally known techniques. In addition, the switch mechanism 34 using the lever 41 and the link 42 can be replaced with other mechanisms. That is, this invention is not necessarily concerned with the details of the switch mechanism of the snare strainer that controls the snappy member to move in close contact with or separate from the backside drumhead.

As shown in FIG. 3, the fixing portion 30B of the moving base 30 is constituted by a plate portion 60 having a trapezoidal shape in plan view, which is integrally attached to the upper portion of the main portion 30A, and an engagement portion 61 that integrally projects from the upper surface of the plate portion 60. The engagement portion 61 is formed in a convex shape in plan view and is constituted by a square portion 61*a* and a pair of legs 61*b*, which are formed on both sides of the square portion 61*a* at its intermediate position and are symmetrically interconnected with both sides of the square portion 61*a*, wherein each of the legs 61*b* has an L-shape in plan view. A tapped hole 63 having an internal thread is formed approximately at the center of the upper portion of the square portion 61*a*. In addition, positioning projections 64 are formed to project from the upper surfaces of the legs 61*b* respectively.

A first holding member 70, which holds the interconnection member 13 attached to the moving end 7A of the snappy member 7 in association with a second holding member 71 (which will be described later), is detachably attached to the fixing portion 30B of the moving base 30. As shown in FIG. 3, the first holding member 70 is constituted by a base fixing portion 70A, which is fixed by being engaged with the upper side or front side of the fixing portion 30B of the moving base 30, and a fastening portion 70B that is integrally formed together with the base fixing portion 70A so as to tightly fasten the interconnection member 13 in association with the second holding member 71. The base fixing portion 70A has an interior shape that engages with the fixing portion 30B, and it also has a pair of small recesses 66 that engages with the projections 64. An elongated hole 75 having an inverted U-shape, which is opened downwards, is formed in the front center portion of the base fixing portion 70A. When a square-headed bolt 74 is inserted into the elongated hole 75 via a washer (not shown) and is screwed into the tapped hole 63 of the fixing portion 30B of the moving base 30, the base fixing portion 70A of the first holding member 70 is detachably fixed to the fixing portion 30B of the moving base 30. The peripheral shape of the elongated hole 75 matches and engages with the shape of the fixing portion 30B and is prevented from being moved horizontally and vertically. Such fixation can be secured by using only a single bolt 74.

The fastening portion 70B of the first holding member 70 is formed in a longitudinally elongated plate like shape, both ends of which tightly hold the interconnection member 13 and are used to fasten square-headed bolts 77. That is, tapped holes 78 are respectively formed in both ends of the fastening portion 70B so as to allow the square-headed bolts 77 to be screwed therein. In addition, a pair of engagement grooves 80 are formed on the internal sides of the fastening portion 70B and are elongated along the overall width of the fastening portion 70B. A pair of through holes 81, into which both ends of the interconnection member 13 of the snappy member 7 are inserted, are formed in the bottoms of the engagement grooves 80 in proximity to the base fixing portion 70A and are respectively open in the backside of the fastening portion 70B. In addition, a horizontally elongated through hole 82 is formed in the front center portion of the fastening portion 70B. This through hole 82 is used to allow insertion of other band-like members such as tapes and belts, which are substituted for strings and wires as the interconnection member 13 of the snappy member 7. That is, the first holding member 70 can be adapted to any types of the interconnection member 13, which is realized as the string, wire, and other band-like member.

The second holding member 71 is formed as a slender plate whose length substantially matches the length of the fastening portion 70B of the first holding member 70. Both ends of the second holding member 71 are formed similar to both ends of the first holding member 70, wherein holes 84 allowing the square-headed bolts 77 to be inserted therein are formed to penetrate through both ends of the second holding member 71. A pair of pressing portions 85 integrally project from both ends of the backside of the second holding member 71 so as to press the interconnection member 13 into the engagement grooves 80 of the first holding member 70, so that the interconnection member 13 is fixed in position. The pressing portions 85 project downward in FIG. 3 in a direction perpendicular to the longitudinal direction of the second holding member 71. The prescribed portions of the interconnection member 13 are inserted into the through holes 81 of the first holding member 70 and are engaged with the engagement grooves 81. In addition, the pressing portions 85 of the second holding member 71 engage with the engagement grooves 80 so as to press and fix the interconnection member 13 in position.

As shown in FIGS. 5A-5C, 6, and 7, the second strainer 90 is constituted by a second fixing base 91 that is fixed opposite to the first fixing base 26 of the first strainer 20 on the exterior circumferential surface of the drum cylinder 2, and a first holding member 92 and a second holding member 93 that hold the interconnection member 13 in proximity to the fixed end 7B of the snappy member 7. The second fixing base 91 is fixed at a prescribed position that is deviated from the first strainer 20 by 180° in the circumferential direction on the exterior circumferential surface of the drum cylinder 2. The second fixing base 91 has a square-pole like shape whose tip end portion is formed in a convex shape substantially matching the shape of the fixing portion 30B of the moving base 30, whereby a fixing portion 91A thereof allows a base fixing portion 92A of the first holding member 92 to be engaged therewith. In addition, a square-headed bolt 94 for fixing the base fixing portion 92A of the first holding member 92 is screwed into a tapped hole that is formed approximately in the center of the tip end portion of the fixing portion 91A.

The first holding member 92 and the second holding member 93 of the second strainer 90 are respectively designed in the same shapes similar to those of the aforementioned first holding member 70 and the second holding member 71 of the first strainer 20. That is, the base fixing portion 92A of the first holding member 92 is detachably fixed to the fixing portion 91A of the fixing base 91 by the square-headed bolt 94, while the second holding member 93 is detachably fixed to a fastening portion 92B of the first holding member 92 by two square-headed bolts 95. The description regarding the details of the first and second holding members 92 and 93 will be omitted.

When the snare drum 1 equipped with the aforementioned snare strainer including the first and second strainers 20 and 90 is played in such a way that the snappy member 7 is controlled not to be brought in close contact with the backside drumhead 3, the operation lever 41 of the first strainer 20 is rotated by a prescribed angle (e.g., 48°) in a clockwise direction (see FIG. 4A in which the lever 41 in solid line illustration is moved as shown by dashed line illustration) about the fixing axis 40 (see FIG. 4B). When the operation lever 41 is rotated in the clockwise direction in FIG. 4A, the link axis 43 is lifted upwards in the upper left direction so that the link 42 is correspondingly lifted up, whereby the adjustment axis 44 moves along the elongated holes 46*a* and 46*b*, so that the tension adjustment screw 18 and the moving base 30 collectively move upwards together with the adjustment axis 44, in other words, they move downwards in FIG. 1. Suppose that the snare drum 1 is located as shown in FIG. 1 in which the backside drumhead 3 is directed downwards so that the first strainer 20 is directed downwards, wherein when the operation lever 41 is operated as described above, the moving base 30 descends down so as to release the moving end 7A of the snappy member 7 from the strained condition in which the moving end 7A is compulsorily lifted up. Hence, the snappy member 7 hangs down due to its own weight and is separated from the backside drumhead 3, whereby it is possible to switch over the snare drum 1 into a non-snare performance mode in which the snare drum 1 is played without using the snappy member 7.

In the aforementioned mode, when the operation lever 41 is rotated in the counterclockwise direction so that it is restored to the original position shown by solid lines in FIG. 1, the moving base 30 is lifted up to the original height so that the snappy member 7 is strained to be brought into close contact with the backside drumhead 3. That is, by simply operating the operation lever 41, it is possible for the snare drum 1 to be switched over from the non-snare performance mode to a snare performance mode in which the snappy member 7 is used in playing.

The tension adjustment screw 18 can be rotated by hand so as to realize fine adjustment on the tension of the snappy member 7 (or tensions of the snares 11). That is, when the tension adjustment screw 18 is rotated in a tightening direction (i.e., a clockwise direction in FIG. 4A), the nut 48 descends down along with the tension adjustment screw 18 (see FIG. 4B) so as to downwardly press the lower partition wall 50*b*. At this time, the moving base 30 also descends down together with the nut 48 so as to lower the moving end 7A of the snappy member 7, thus increasing tensions of the snares 11. In contrast, when the tension adjustment screw 18 is rotated in a loosening direction (i.e., a counterclockwise direction in FIG. 4A), the nut 48 moves forward relative to the tension adjustment screw 18 so as to upwardly press the upper partition wall 50*a*. This causes the moving base 30 to move upwards and approach the snappy member 7, whereby tensions of the snares 11 decrease. Herein, it is possible for the human operator to visually determine the degree of variations of tensions of the snares 11 by observing the movement of the moving base 30 on the scale 56 relative to the adjustment axis 44.

When the backside drumhead 3 is replaced with another drumhead, the square-headed bolt 74 of the first strainer 20 is loosened first; then, the moving base 30 is removed from the fixing portion 30B in such a way that the first holding member 70 is slid and extracted from the U-shaped elongated hole 75. In addition, the square-headed bolt 94 of the second strainer 90 is loosened, so that the first holding member 92 is removed from the second fixing base 91. Furthermore, the snappy member 7 is removed together with the first and second holding members 70 and 71 being attached to both ends of the interconnection member 13. Thus, it is possible to replace the backside drumhead 3 with another drumhead. Incidentally, the replacement of the backside drumhead 3 is performed by removing the hoop 4 from the snare drum 1 according to normal procedures.

In order to re-install the snappy member 7 in the snare drum 1 after the completion of the replacement of the backside drumhead 3, the base fixing portion 70A of the first holding member 70 is engaged with the fixing portion 30B of the moving base 30 of the first strainer 20; then, the square-headed bolt 74 is tightened so that the first holding member 70 is fixed to the fixing portion 30B of the moving base 30. In addition, the base fixing portion 92A of the first holding member 92 is engaged with the fixing portion 91A of the second fixing base 91 of the second strainer 90; then, the square-headed bolt 94 is tightened so that the first holding member 92 is fixed to the second fixing base 91.

As described above, the present embodiment allows the drumhead replacement to be carried out by merely removing the first holding members 70 and 92 from the first and second strainers 20 and 90 respectively, wherein it is unnecessary to remove the second holding members 71 and 93 from the first holding members 70 and 92 respectively. This makes it easy for the human operator to handle the snappy member 7 in the replacement of the backside drumhead 3, which can be therefore carried out with ease and within a short period of time.

Since it is unnecessary to remove the second holding members 71 and 93 from the first holding members 70 and 92, it is unnecessary for the human operator to perform tension adjustment, i.e., positional adjustment between the snappy member 7 and the first and second holding members 70 and 71, when the snappy member 7 is re-installed in the snare drum 1.

In the present embodiment described above, the prescribed strings or wires are used for the 'flexible' interconnection member 13 whose both ends are fixed in position by the snappy member 7. Of course, this invention is not necessarily limited to the present embodiment; hence, it is possible to use a belt having an appropriate width, which can be inserted into the elongated hole 82 of the first holding member 70, as the interconnection member 13. In this case, it is necessary to form a projection member (or a pressing member), which presses the belt into the elongated hole 82, integrally in the backside of the second holding member 71.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A snare strainer including a first strainer and a second strainer, which are attached to opposite positions on an exterior circumferential surface of a drum cylinder and by which a snappy member is controlled to move in close contact with or separate from a drumhead, wherein said first strainer comprises a first fixing base that is fixed to the exterior circumferential surface of the drum cylinder, a moving base that is attached to the first fixing base in a free movement manner, a switch mechanism that moves the moving base relative to the first fixing base, thus controlling the snappy member to move in close contact with or separate from the drumhead, and a pair of first and second holding members that hold an interconnection member having flexibility at one end of the snappy member, and wherein the first holding member has a fastening portion and a base fixing portion, which is detachably attached to the moving base, through holes allowing insertion of the interconnection member therein and engagement grooves are formed in the fastening portion of the first holding member, and a pressing member for pressing the interconnection member into the engagement grooves is integrally formed with the second holding member.

2. A snare strainer according to claim 1, wherein the first strainer is equipped with a tension adjustment means for adjusting tension applied to the snappy member, and wherein the moving base has a scale for visually showing movement of the moving base moved by the tension adjustment means.

3. A snare strainer according to claim 1, wherein a plurality of positioning means are arranged to establish positioning between the base fixing portion of the first holding member and the moving base.

4. A snare strainer according to claim 3, wherein the plurality of positioning means comprise a plurality of projections and recesses engaged with each other and provided on said first holding member and said moving base.

5. A snare strainer including a first strainer and a second strainer, which are attached to opposite positions on an exterior circumferential surface of a drum cylinder and by which a snappy member is controlled to move in close contact with or separate from a drumhead, wherein said first strainer comprises a first fixing base that is fixed to the exterior circumferential surface of the drum cylinder, a moving base that is attached to the first fixing base in a free movement manner, a switch mechanism that moves the moving base relative to the first fixing base, thus controlling the snappy member to move in close contact with or separate from the drumhead, and a pair of first and second holding members that hold an interconnection member having flexibility at one end of the snappy member, and wherein the first holding member has a fastening portion and a base fixing portion, which is detachably attached to the moving base, a second fixing base that is fixed to the exterior circumferential surface of the drum cylinder, and a pair of third and fourth holding members that hold the interconnection member at other end of the snappy member, and wherein the third holding member has a fastening portion and a base fixing portion, which is detachably attached to the second fixing base, through holes allowing insertion of the interconnection member therein and engagement grooves are formed in the fastening portion of the third holding member, and a pressing member for pressing the interconnection member into the engagement grooves is integrally formed with the fourth holding member.

6. A snare strainer according to claim 5, wherein a plurality of positioning means are arranged to establish positioning between the base fixing portion of the third holding member and the second fixing base.

7. A snare strainer according to claim 6, wherein the plurality of positioning means comprise a plurality of projections and recesses engaged with each other.

* * * * *